US005205074A

United States Patent [19]

Guhl et al.

[11] Patent Number: 5,205,074

[45] Date of Patent: Apr. 27, 1993

[54] COUNTERBALANCED WINDOW OPERATORS

[75] Inventors: James C. Guhl, Hudson, Wis.; Jurgen R. Martens, Leinfelden-Echterdingen, Fed. Rep. of Germany; Hartmut Ginnow-Merkert, Orono, Minn.; Harald Tomanek, Leinfelden-Echterdingen, Fed. Rep. of Germany

[73] Assignee: Andersen Corporation, Bayport, Minn.

[21] Appl. No.: 800,595

[22] Filed: Nov. 27, 1991

Related U.S. Application Data

[63] Continuation-in-part of Ser. No. 619,111, Nov. 28, 1990, Pat. No. 5,097,629.

[51] Int. Cl.[5] ..... E05F 1/10; E05F 11/00

[52] U.S. Cl. ..... 49/386; 49/324; 74/89.14; 267/175

[58] Field of Search ..... 49/386, 324, 341, 342, 49/343, 350, 351; 74/89.14, 89.15; 267/175

[56] References Cited

U.S. PATENT DOCUMENTS

| | | | |
|---|---|---|---|
| 2,226,376 | 12/1940 | Harrison | 49/342 X |
| 2,698,173 | 12/1954 | Rydell | 49/386 X |
| 2,767,979 | 10/1956 | Hummert | 49/324 |
| 2,811,349 | 10/1957 | Bondurant et al. | 49/324 |
| 2,817,511 | 12/1957 | Reynaud | 268/105 |
| 3,098,647 | 7/1963 | Teggelaar et al. | 49/342 X |
| 3,214,157 | 10/1965 | Stavenau | 49/324 |
| 3,284,076 | 11/1966 | Gibson | 267/175 |
| 3,508,362 | 4/1970 | Wright | 74/89.14 X |
| 4,143,556 | 3/1979 | Hauber | 49/324 X |
| 4,241,541 | 12/1980 | Van Klompenburg et al. | 49/342 X |
| 4,266,371 | 5/1981 | Erdman et al. | 49/342 X |
| 4,305,228 | 12/1981 | Nelson | 49/342 X |
| 4,416,094 | 11/1983 | Bügener et al. | 49/386 X |
| 4,505,601 | 3/1985 | Sandberg et al. | 384/428 |
| 4,521,993 | 6/1985 | Tacheny et al. | 49/325 |
| 4,571,775 | 1/1986 | Leonard | 16/298 |
| 4,617,758 | 10/1986 | Vetter | 49/342 X |
| 5,097,629 | 3/1992 | Guhl et al. | 49/386 |

FOREIGN PATENT DOCUMENTS

| | | |
|---|---|---|
| 607900 | 7/1933 | Fed. Rep. of Germany . |
| 824752 | 1/1952 | Fed. Rep. of Germany . |
| 9003179.2 | 5/1990 | Fed. Rep. of Germany . |
| 9017445.3 | 3/1991 | Fed. Rep. of Germany . |
| 2270424 | 12/1975 | France . |
| 2307674 | 11/1976 | France . |
| 1527723 | 10/1978 | United Kingdom . |

*Primary Examiner*—Philip C. Kannan

*Attorney, Agent, or Firm*—Merchant, Gould, Smith, Edell, Welter & Schmidt

[57] ABSTRACT

A counterbalanced window operator includes a rotatable drive member operatively connected to the pivoting end of the window by means of an arm member (29). A spring (40) occupying a fixed orientation is operatively connected to the arm member (29) to counterbalance the torque transmitted from the window to the arm member (29). In a preferred embodiment, double scissors arm members (250*a* and 250*b*) include a pair of first arm members (251*a* and 251*b*) that define a first plane and a pair of second arm members (252*a* and 252*b*) that define a second plane at an oblique angle relative to the first plane when the window is in an open position.

23 Claims, 11 Drawing Sheets

12e
29c
29
29b
29a
30
30a
30b
30c
21
40
40a
40b
41
42
43
44
45
45a
45b
46
47
48
49
50
54
27
28
31
32
33
β

241
230
292b
200
280b
281b
252b
250b
251b
297b
270b
290
219
213b
290
260b
253b
293b
215b
214b
296a
295b
212
201
211
234
291
295a
298b
293a
231
215a
214a
210
253a
290
213a
290
260a
252a
297a
251a
270a
250
292a
280a
281a 270a
298a
280a
283a
282a
281a
298a

COUNTERBALANCED WINDOW OPERATORS

This application is a continuation-in-part of U.S. patent application Ser. No. 07/619,111 filed Nov. 28, 1990, now U.S. Pat. No. 5,097,629.

BACKGROUND OF THE INVENTION

1. Field of the Invention

This invention relates generally to counterbalanced window operators and more particularly to a counterbalanced operator wherein the counterbalancing force is connected to the arm members and adjustments are able to be made to the counterbalanced mechanism to accommodate various pitches of the roof, weight of the sash and size of the sash.

2. Description of the Prior Art

It is well known in the art to utilize a crank operator for casement type windows. For such windows, the operators have performed satisfactorily. However, when a crank operator has been used for roof or awning windows, various problems have arisen. The first is that due to the weight of the sash, it is necessary that there be a large gear reduction between the crank and the operator mechanism. Typically, it has taken between 25 to 30 revolutions of the hand crank in order to effect a 12 inch (30 cm) movement of the window. Therefore, in order to open a window, it was necessary for a person to make a large number of revolutions of the hand crank. This becomes quite cumbersome for the person operating the mechanism. Furthermore, even with the large gear reduction, the weight of a large roof window sash can cause the cranking torque to be quite high.

Other objects which need to be opened, such as garage doors, are typically counterbalanced in order to allow the person operating the garage door to more easily open and close the garage door. The counterbalancing means are typically located proximate the sides of the garage door. Still further, counterbalancing mechanisms have been utilized in certain windows, but not in the housing of the crank mechanism and not with the counterbalancing forces applied to the same members that open and close the sash from the crank mechanism.

One of the problems which would be encountered in counterbalancing either a roof or awning window would be that the amount of counterbalancing force needed would vary depending upon the pitch of the roof on which the window was placed as well as the size and weight of the sash. With roof windows having arm members attached to the pivoting end of the window, another problem arises from the fact that the pivoting end of the window traces out an arc as the window is opened, but the arm members typically extend linearly. To compensate for the different modes of extension, the joints of the arm members are made relatively loose to provide flexibility.

The present application addresses the problems associated with the prior art devices and provides for a counterbalanced window operator with counterbalance forces on the same members as the crank mechanism. The counterbalancing mechanism may be adjusted to take into account the various roof pitches as well as weight and size of sashes. Still further, the mechanism is designed to match the counterbalancing torque to the torque created by the sash throughout the opening and closing of the window, and the arm members extend in non-linear fashion to better approximate the movement of the pivoting end of the unit.

SUMMARY OF THE INVENTION

The present invention is a counterbalanced operator for a pivoting unit, the unit having a first, pivoted end and a second, rotatable end. The operator includes a housing and a rotatable drive member operatively mounted in the housing. The drive member has an axis of rotation. An arm member, having first and second ends, has its first end operatively connected to the drive member. The second end of the arm is operatively connected to the second end of the pivoting unit, wherein a torque from the unit is transmitted to the arm member. A rotating drive means is provided for rotating the drive member and further a means for counterbalancing the torque of the arm member is provided. The counterbalancing means creates a force, the counterbalancing means being operatively connected to the arm member such that the force is being transmitted to the arm member.

In another embodiment, the invention is a counterbalanced operator for a pivoting window, the window having a first pivoting end and a second rotatable end. The operator includes a housing and a rotatable drive member operatively mounted in the housing. The drive member has an axis of rotation. An arm member having first and second ends has its first end operatively connected to the drive member. The second end of the arm is operatively connected to the second end of the pivoting window, wherein a torque from the window is transmitted to the arm member. A rotating drive means is provided for rotating the drive member and further a means for counterbalancing the torque of the arm member is provided. The counterbalancing means creates a force, the counterbalancing means being operatively connected to the arm member such that the force is being transmitted to the arm member.

In another embodiment, the invention is a window having a frame with a top end and a bottom end. A sash having a top and bottom end is configured to engage the frame and the top of the sash is pivotally mounted to the top end of the frame. The bottom end being the rotatable end. A counterbalanced operator is provided which includes a housing and a rotatable drive member operatively mounted in the housing. The drive member has an axis of rotation. An arm member having first and second ends has its first end operatively connected to the drive member. The second end of the arm is operatively connected to the second end of the sash, wherein a torque from the sash is transmitted to the arm member. A rotating drive means is provided for rotating the drive member and further a means for counterbalancing the torque of the arm member is provided. The counterbalancing means creates a force, the counterbalancing means being operatively connected to the arm member such that the force is being transmitted to the arm member.

In a preferred embodiment, the present invention provides an operator for a pivoting unit, the unit having a first, pivoted end and a second, rotatable end. The operator includes a rotatable drive member having an axis of rotation and operatively mounted in a housing. The drive member is operatively connected to first ends of a pair of first arm members, and second, opposite ends of the first arm members are operatively connected to first ends of a pair of second arm members. Second, opposite ends of the second arm members are operatively connected to the second, rotatable end of the pivoting unit, such that a torque from the unit is transmitted to the first and second arm members. The second, rotatable end of the pivoting unit is rotatable from a closed position to an open position. When the second, rotatable end is in the open position, the first arm members generally define a first plane, and the second arm members generally define a second plane at an oblique angle relative to the first plane. The operator further includes a rotating drive means for rotating said drive member. Also, a counterbalancing means is operatively connected to the first arm members, for counterbalancing the torque on the first and second arm members. The counterbalancing means creates a force that is transmitted to the first and second arm members.

A pair of linking members operatively connects the first arm members to the drive member so as to provide an over center advantage as the second, rotatable end of the pivoting unit is rotated to the closed position. Also, when the second, rotatable end of the pivoting unit is in the closed position, the second arm members generally define a third plane at an angle less oblique relative to the first plane, and the first arm members continue to generally define the first plane. The second ends of the first arm members are bent out of the first plane toward the second plane, and the first ends of the second arm members are bent out of the second plane toward the first plane. The first arm members have a common pivot point, and the second arm members are individually, pivotally connected to a hinge member on the second, rotatable end of the pivoting unit.

The drive means includes a worm drive that is rotated by rotation of a crank handle, and a worm gear in operative engagement with the worm drive. A propelling member is operatively connected to the worm gear, and the drive member has a socket configured to receive the propelling member. The counterbalancing means includes a pair of springs operatively connected to the first ends of the first arm members. An adjusting means is operatively connected to the springs, for adjusting preload forces on the springs, and a gauging means is provided for gauging adjustments to the preload forces on the springs.

DETAILED DESCRIPTION

Figure 1:
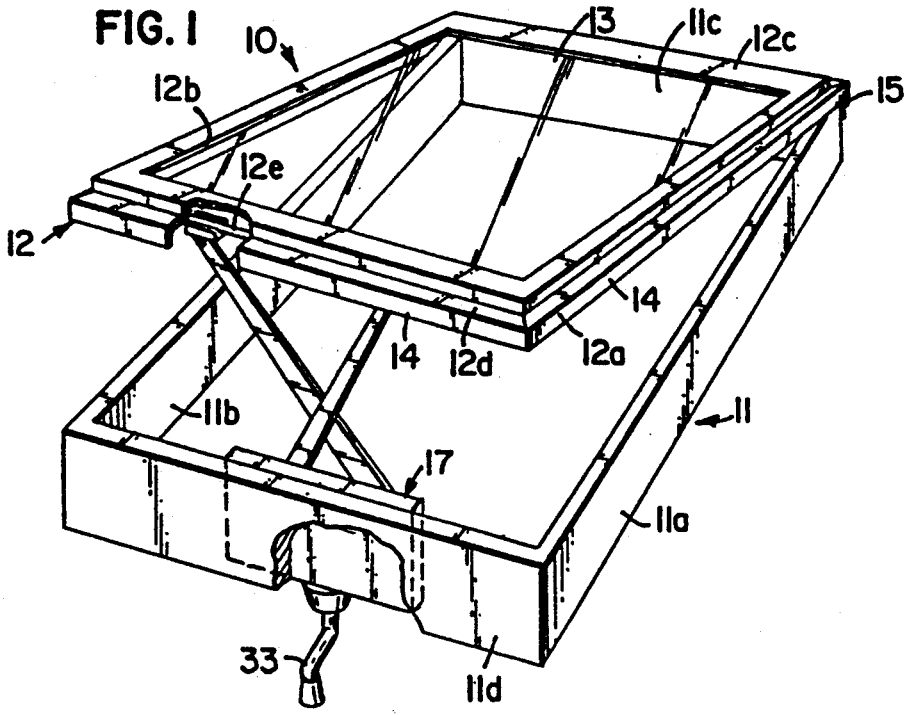
FIG. 1 is a perspective view of a roof window showing the counterbalanced window operator mounted to the sill of the window frame.

Referring to the drawings, wherein like numerals represent like parts throughout the several views, there is generally disclosed at 10 a roof window. The frame, generally designated at 11, includes side members **11*a* and 11*b* connected at the top end by top member 11*c* and at the bottom end by sill 11*d*. A sash, generally designated at 12, has side members 12*a* and 12*b* cooperatively connected by top member 12*c* and bottom member 12*d*. A transparent material 13, usually either glass or plastic, is operatively mounted in the sash 12, by means well known in the art. The transparent material 13 may be single, double or triple pane, depending upon the desired functional characteristics. The sash 12 has an outer flange 14.which extends around the four sides of the sash 12 and is configured to fit over the frame 11 and provide a suitable seal. A hinge 15 is connected to the frame 11 and sash 12 proximate the top end on a first side and another hinge (not shown) is similarly attached to the frame and sash proximate the other side. The construction of the window 10, described so far, is well known in the art and such a construction or other suitable constructions may be utilized with the counterbalanced window operator mechanism 16**.

The mechanism 16 includes a housing 17. The housing 17 is generally rectangular in shape and has an inner cavity **17*a*. The housing 17 has a base 18 operatively connected to sidewalls 19, 20 and 21. A top 22 having a downwardly depending sidewall 23 is releasably connected to the housing 17 by means of four screws 24**.

Figure 2:
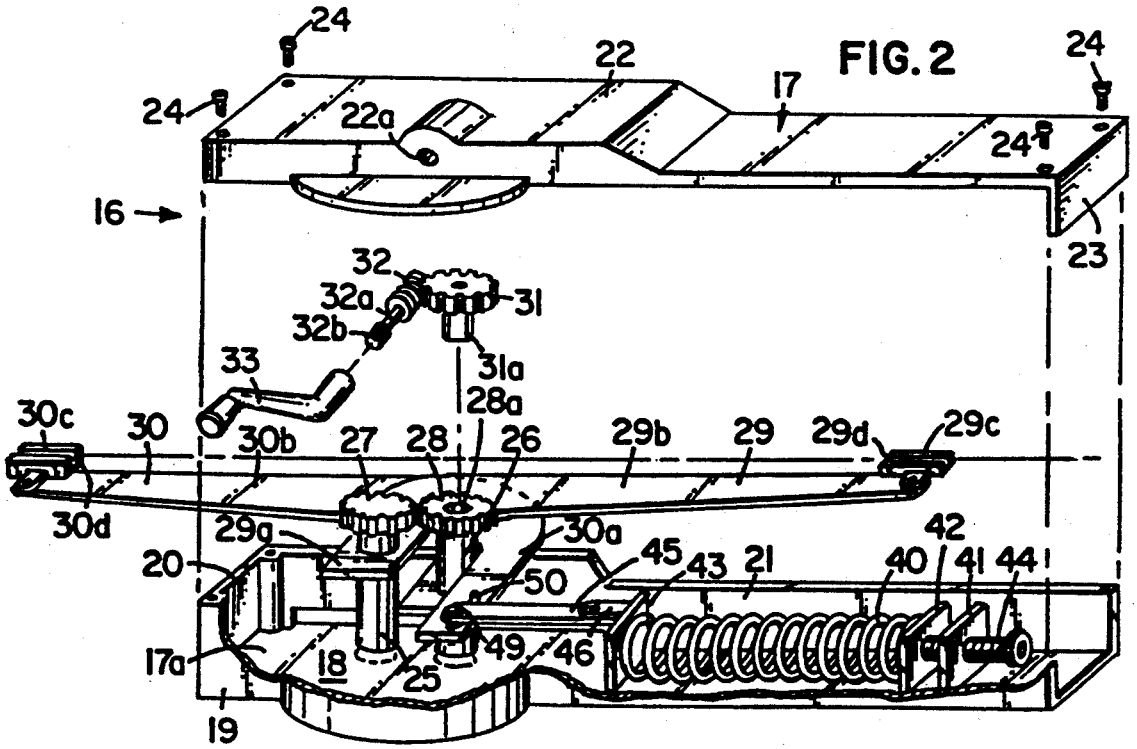
FIG. 2 is a perspective view of the counterbalanced window operator shown in FIG. 1.

Two standoffs 25 and 26 are operatively connected by suitable means to the base 18 to allow the standoffs 25 and 26 to rotate. Two eighteen tooth spur gears 27 and 28 are operatively mounted to the standoffs 25 and 26 respectively. The spur gears 27 and 28 are free to rotate around a generally vertical axes of rotation, as shown in FIG. 2. These axes of rotation are in alignment with the standoffs 25 and 26. The gears 27 and 28 are respectively fixed to the standoffs so that the gears 27 and 28 and standoffs 25 and 26 will rotate together. A first arm 29 is operatively connected to the first standoff 25 and a second arm 30 is operatively connected to the second standoff 26. The arms 29 and 30 may be welded to the respective standoffs such that rotation of the standoffs causes rotation of the arms. The arms 29 and 30 each have a relatively short first leg 29*a* and 30*a* operatively connected to a second leg 29*b* and 30*b*. The first legs are approximately 90° to the second legs. A worm gear 31 has a shaft 31*a* which is positioned in an opening 28*a* of spur gear 28 such that rotational movement of the worm gear 31 causes rotation of the spur gear 28. A worm 32 is positioned so as to be in operative engagement with the worm gear 31. The worm 32 has a shaft 32*a* on which a knurled knob 32*b* is connected. The shaft 32*a* extends through the opening 22*a* in the top 22. The gear 31 is a 63:1 reduction in connection with worm 32. The worm drive gives the operator a self locking feature by preventing unintended sash movement due to gusts of wind or other forces. A crank handle 33 is operatively connected to the knob 32*b* so that revolvement of the crank 33 causes the worm 32 to rotate, thereby causing the worm gear 31 to rotate which in turn causes the spur gear 28 and therefore spur gear 27, which meshes with gear 28, to rotate. The standoffs 25 and 26 thereby rotate carrying with them the arms 29 and 30. The sash 12 has a steel guide bar 12*e* across its bottom end. At the end of each of the arms 29 and 30 are guide shoes 29*c* and 30*c*, respectively. The guide shoes 29*c* and 30*c* have a longitudinal opening 29*d* and 30*d* on which the steel guide bar 12*e* is positioned. The shoes 29*c* and 30*c* are pivotally connected to the arms 29 and 30. It is also understood that the second ends 29*b* and 30*b* may not be directly connected to the sash. Another arm member or linkage member may be connected between the sash and the second ends 29*b* and 30*b*. One example of this would be a double scissors arm system. The mechanism described so far, except for the size of the gears 27, 28, 31 and 32, is quite typical of the prior art operators and construction could be by any suitable means, well known in the art.

The housing 17 is elongate so as to allow room for the mounting of a spring 40 which provides a counterbalancing force. Alternately, the spring could be positioned outside of the housing. The spring 40 may either be a compression spring, as shown in the drawing, or extension spring. A plate 41 is operatively connected, by suitable means such as welding, to the base 18. The spring 40 has a first end 40*a* which is operatively connected to a plate 42 and a second end 40*b* is operatively connected to a plate 43. Adjustment bolt 44 is positioned through an aperture in the plate 41. The bolt 44 may be rotated so that its threads engage the threaded aperture in the plate 41. The causes the bolt to travel in the direction of the arrows shown in FIG. 3 and thereby adjusts the compression, or preload on the spring 40.

A connecting arm 45 is pivotally mounted between the plate 43 and the second arm 30. The connecting arm 45 has a first end 45*a* and a second end 45*b*. A second connecting arm 46, at one end, is rotatably mounted to the connecting arm 45 by a pin 47 and out the other end is secured to the plate 43 by suitable means such as welding. The first end 45*a* of the connecting arm 46 is spaced slightly away from the plate 43 such that when the arm 45 rotates slightly around the pin 47, the connecting arm 45 does not hit the plate 43. An arcuate slot 50 is formed in the first end 30*a* of the second arm member 30. The second end 45*b* of the connecting arm 45 is secured in the slot 50 by means of bolt 48 and nut 49. The nut 49 may simply be loosened and the arm 45 may be moved to any position along the slot 50 and then secured in position by means of the nut 49. This adjustment allows the user to select various spring arm lengths and different angle betas as will be described more fully hereafter. The different locations were utilized in comprising the data shown in Table I. It is also understood that the end 45*b* may be connected to the arm 30 by means such as a suitable linkage.

Figures 3, 3A, 4:
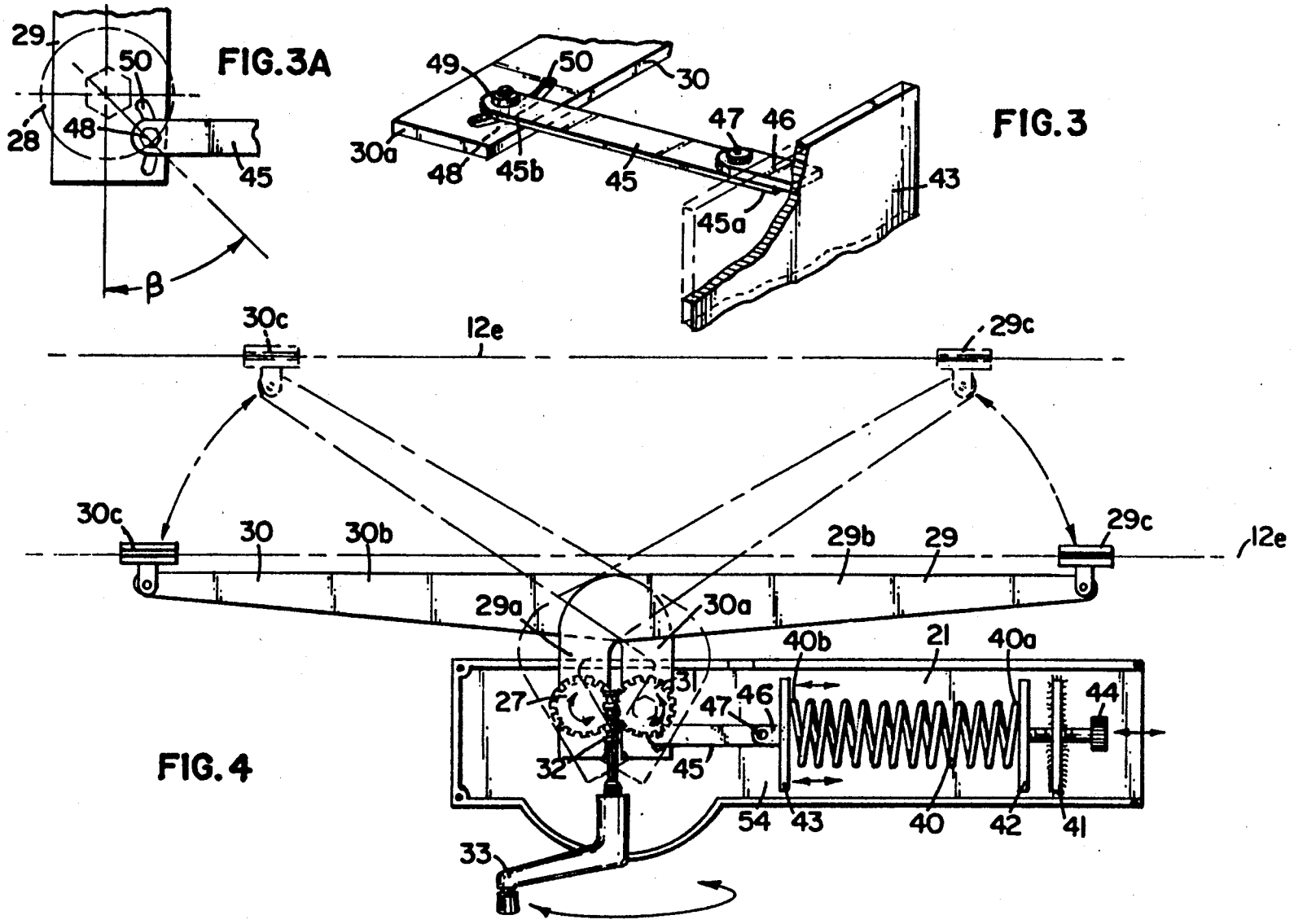
FIG. 3 is a top plan view of a portion of the window operator shown in FIG. 2.
FIG. 3*a* is a top plan view of a portion of the window operator shown in FIG. 1.
FIG. 4 is a top plan view of the operator shown in FIG. 2 with the cover removed.

FIG. 3*a* depicts the angle beta. This angle beta is necessary in calculating the torque which is provided by the spring 40. The spring arm length is the distance between the center of the bolt 48 and the center of the gear 28. However, the torque about the axis of rotation of the gear 28 is equal to the spring arm length times spring force times cosine beta. The spring force is determined by the spring preload and then by the amount of movement in plate 43 as the arms 29 and 30 rotate.

In use, the operator mechanism 16 is mounted on the sill 11*d* of the frame 11 by any means well known in the art. The crank handle 33 is operated from the inside of the building in which the window is mounted. There is typically an insect screen between the handle and the sash. The arms 29 and 30 pass under the screen.

Figure 5:
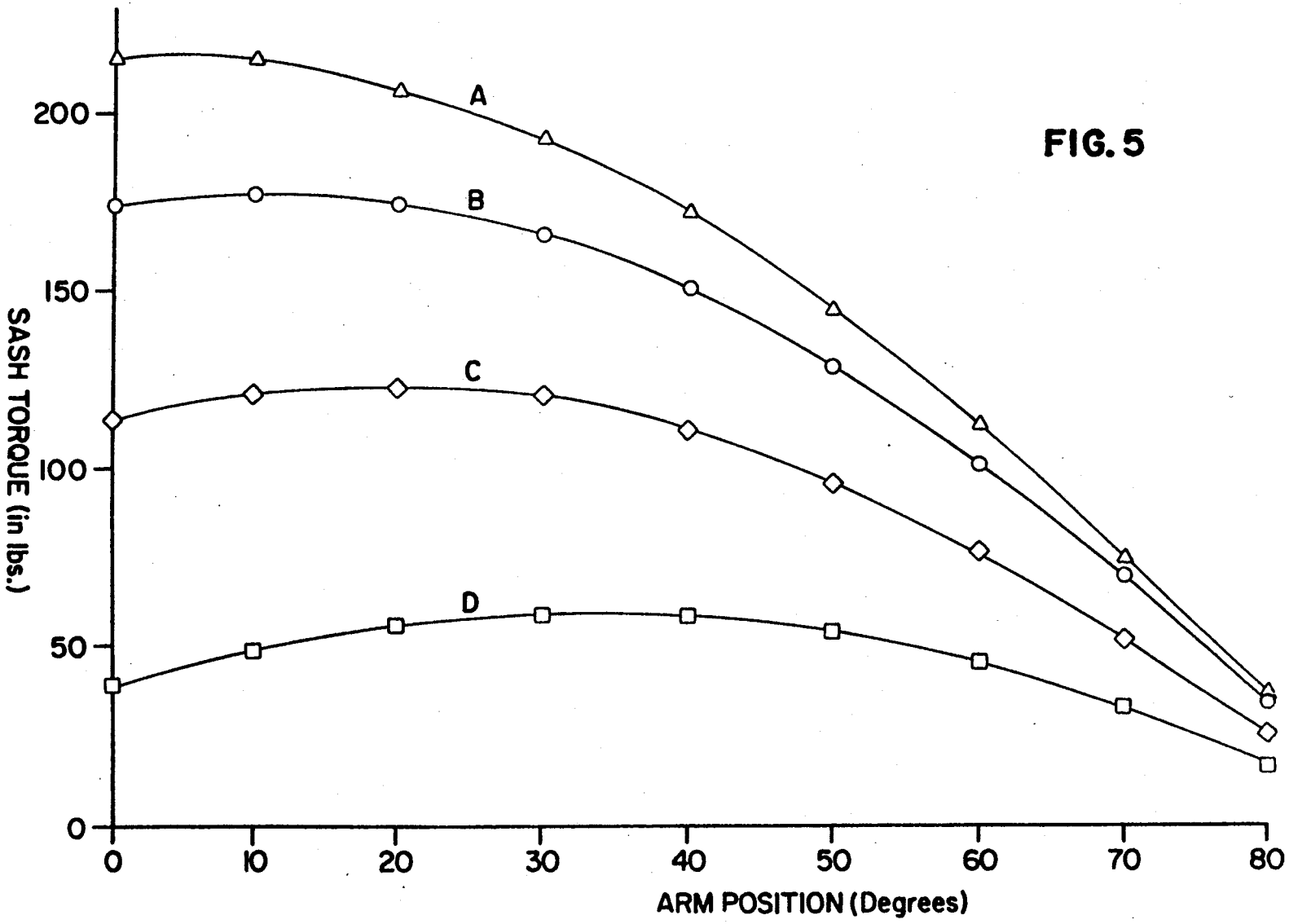
FIG. 5 is a graph of the total sash torque at the arm pivot point for arm pivot range from 0 to 80 degrees.

The torque created by a roof window will vary depending upon the size and weight of the window as well as the pitch of the roof on which the window is mounted. FIG. 5 is an example of the torque in inch pounds which is created by a 29 inch (73 cm) by 44 inch (112 cm) window that weighs 38 pounds (17 kg). Line A represents a roof with an 18 ½° pitch, Line B a 40° pitch, Line C a 60° pitch and Line D an 80° pitch. Roof pitch is measured from the horizontal. The torque is plotted against the position of the arms 29 and 30, 0° being in the closed position.

Figure 6:
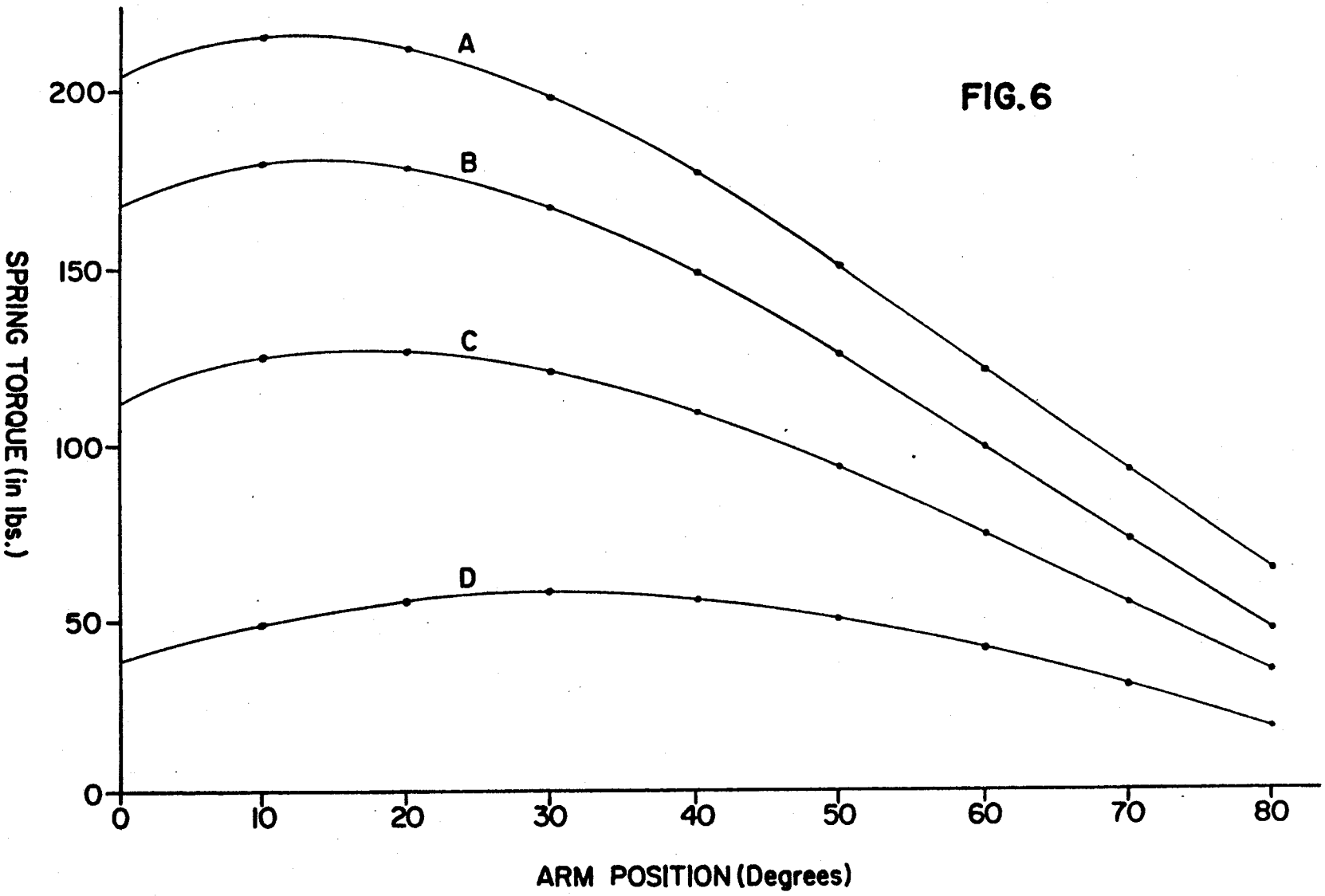
FIG. 6 is a graph showing the spring torque of the counterbalancing mechanism at arm positions of from 0 to 80 degrees.

Ideally, the spring torque would coincide exactly with the sash torque. FIG. 6 is an example of spring torque calculated under the following conditions.

TABLE I

| Line | Roof Pitch (Degrees) | Spring Arm Length (cm) | Spring Rate (g/cm) | Spring Preload (kg) | Beta (Degrees) |
|---|---|---|---|---|---|
| A | 18½ | 12.5 | 5,400 | 36 | 42 |
| B | 40 | 11.25 | 5,400 | 27 | 44 |
| C | 60 | 8.75 | 5,400 | 18 | 50 |
| D | 80 | 5 | 5,400 | 9 | 65 |

The torque, using the above data, was plotted and is shown in FIG. 6. This coincides with the data calculated from the foregoing table.

By loosening the nut 49 and moving the end 45*b* over the slot 50, the spring arm length is able to be adjusted. As the spring arm length is decreased and the angle beta is increased, the amount of torque is reduced.

The connecting mechanism between the spring 40 and the arm 29 is shown as being able to be adjusted so as to adjust the spring arm length and the angle beta. This is done so that the sash torque may be more fully matched by the spring torque. While this is an ideal construction, it has been found practically that there may be a more direct connection between the spring 40 and the arm 29 and not allow for adjustments in the spring arm length and the angle beta. The sash torque can be matched by simply adjusting the spring preload. The spring preload is adjusted by the movement of the adjustment bolt 44 which either compresses or decompresses the spring 40. While the spring torque curve does not as ideally match the sash torque curve when the spring arm length and the angle beta is not adjustable, for production purposes it is found to be sufficiently close.

When the window or pivoting unit is in a closed position, the arms are in a position as shown in FIG. 4. Then, the crank is rotated which turns worm 32 and therefore worm gear 31. The worm gear 31, shaft 31*a*, which is inserted into the socket 28*a* of gear 28, and the gear 28 then drives the driven gear 27. This causes rotation of both the standoffs 25 and 26 which in turn causes the arms 29 and 30 to move in a direction as shown in dashed lines in FIG. 4. The counterbalancing torque is provided by the spring 46 and is directly transmitted to the arm 29 through the arm 45. This counterbalancing force counteracts the torque of the sash so that the crank 34 is more easily operated. Because of the counterbalancing force, a gear ratio is able to be used which will allow the fourteen or less revolutions of the crank to result in the arms rotating from a closed (0° ) to an open (80° ) position. It is the reduction between the gear 31 and worm 32 which determine how many revolutions are necessary to open and close the window completely. Because of the counterbalancing force, the reduction can be further reduced from the 63:1 ratio to a 27:1 ratio which would allow only six revolutions to move between an open and closed position. As the window is opened, the torque will vary similar to that shown in FIGS. 5 and 6. As the arm 29 moves, arm 45 will also move, thereby moving the plate 43 and the spring compression. The pin 47 allows the arm 45 to rotate to compensate for the arm 29*a* moving in an arcuate movement.

In addition to the advantages previously shown and discussed with the present invention, the present invention also has the advantage of allowing a window to be designed which is not restricted by large hollow sash profiles. In prior art devices, the large hollow sash profiles were necessary to house the spring mechanism and hardware within the sash or frame. With the present invention, it is no longer necessary and one is able to have a much "cleaner" or thinner sash profile.

Figure 7:
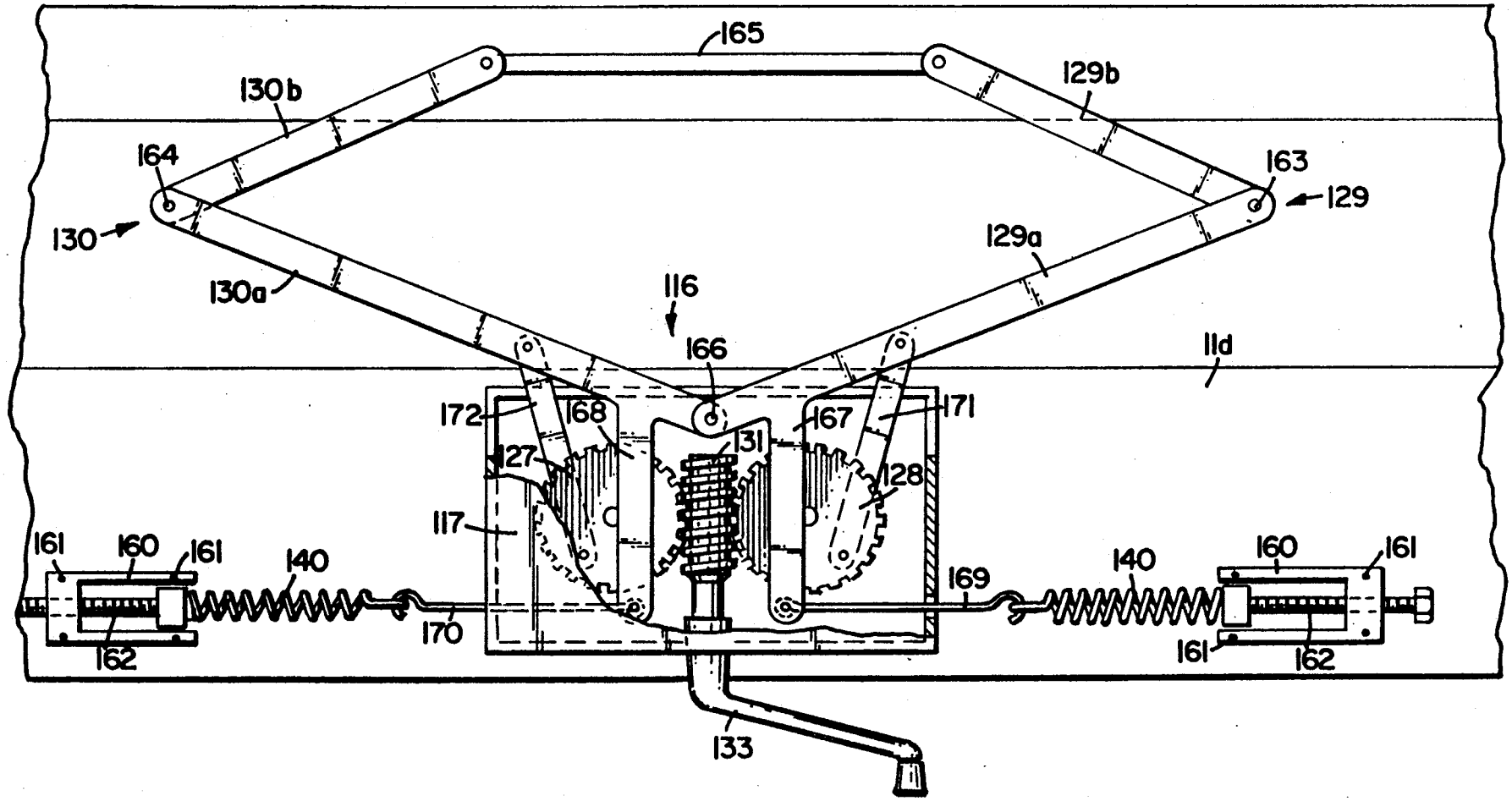
FIG. 7 is a top plan view of another embodiment of the counterbalanced window operator of this invention.

After the initial conception reduction to practice of this invention, the assignee of the present application, Andersen Corporation, began a joint development effort with Roto Frank AG. During this joint development, the inventors of the present application worked in close conjunction with employees of Roto Frank AG and developed what is presently thought to be the embodiment which will be the production when a counterbalanced operator to be sold by Andersen Corporation. This embodiment of the present invention is shown in FIG. 7. There are five major differences between the previously described embodiment and the embodiment shown in FIG. 7. The first is the use of a double scissors arm mechanism. The second is the use of two extension springs instead of one compression spring which are operatively connected to the sill 11*d*. The third is the use of an over center concept. The fourth is that the worm directly drives both gears. The fifth is that there is only an adjustment of the spring preload and not of the arm length and angle $\beta$.

The counterbalanced window operator 116 is mounted to the sill 11*d*. The mechanism includes a housing 117 which is mounted, by suitable means such as screws, to the sill 11*d*. The housing 117 has an opening through which the crank handle 133 may protrude. Two gears 127 and 128 are mounted by standoffs (not shown) to a base plate of the housing 117. A worm 131 is operatively positioned between the two gears 127 and 128. Two adjustment brackets 160 are secured to the sill 11*d* by suitable means such as screws 161. Threaded bolts 162 are operatively mounted in threaded holes in the adjustment brackets 160. Rotation of the bolts 162 causes the bolts to move with respect to the brackets 160. At the end of the bolts 162 are attached extension springs 140.

The double scissors arm system includes a first arm 129 and a second arm 130. The first arm 129 has a first section 129*a* and a second section 129*b*. Similarly, the second arm has a first section 130*a* and a second section 130*b*. The first and second sections are pivotally connected by means of a pin 163 and 164, respectively. The second sections 129*b* and 130*b* are secured to the bottom member 12*d*, which is the rotatable end of the window, by any suitable means. The second sections are joined by a crossbar 165. The first sections 129*a* and 130*a* are pivotally mounted together by pin 166. Downwardly depending (as viewed in FIG. 7) arm members 167 and 168 are rigidly connected at one end to the sections 129*a* and 130*a*. At the other end, the arm members 167 and 168 are designed to be connected to the spring 140. As shown in the drawing, an aperture is formed in each of the arm members 167 and 168. A first connecting member 169 connects the arm member 167 to the spring 140 and the second connecting member 170 operatively connects the other arm member 168 to the other spring 140. In one embodiment, it is contemplated that in production the adjustment brackets would be fixed at a certain distance away from the housing 170 independent of the weight of the window and the pitch of the roof. Then, depending upon the weight of the window and the pitch of the roof, different sized springs 140 may be utilized. Adjustments may be made to the preload of the springs 140 by movement of the adjustment bolts 162 in the adjustment brackets 161.

One additional feature of this embodiment is the use of the over center members 171 and 172. One end of the members 171 and 172 is respectively connected to the sections 129*a* and 130*a*. The other ends are operatively connected to the gears 128 and 127 respectively. The members 171 and 172 are positioned such that when the window is substantially closed, the points of attached and the center of their respective gears form a straight line. Then, one additional turn of the crank 133 provides a substantial closing force to make certain that the window is very tightly closed. A stop can be position such that the crank can not make more than one additional turn past this point.

DETAILED DESCRIPTION

A preferred commercial embodiment of the present invention is designated generally as 200 in FIGS. 8–19. Those skilled in the art will recognize that this particular embodiment 200 may be viewed as a refined version of the embodiment shown in FIG. 7. However, the preferred commercial embodiment 200 shown in FIGS. 8–19 will be separately discussed in detail for purposes of clarity.

Figures 8, 18:
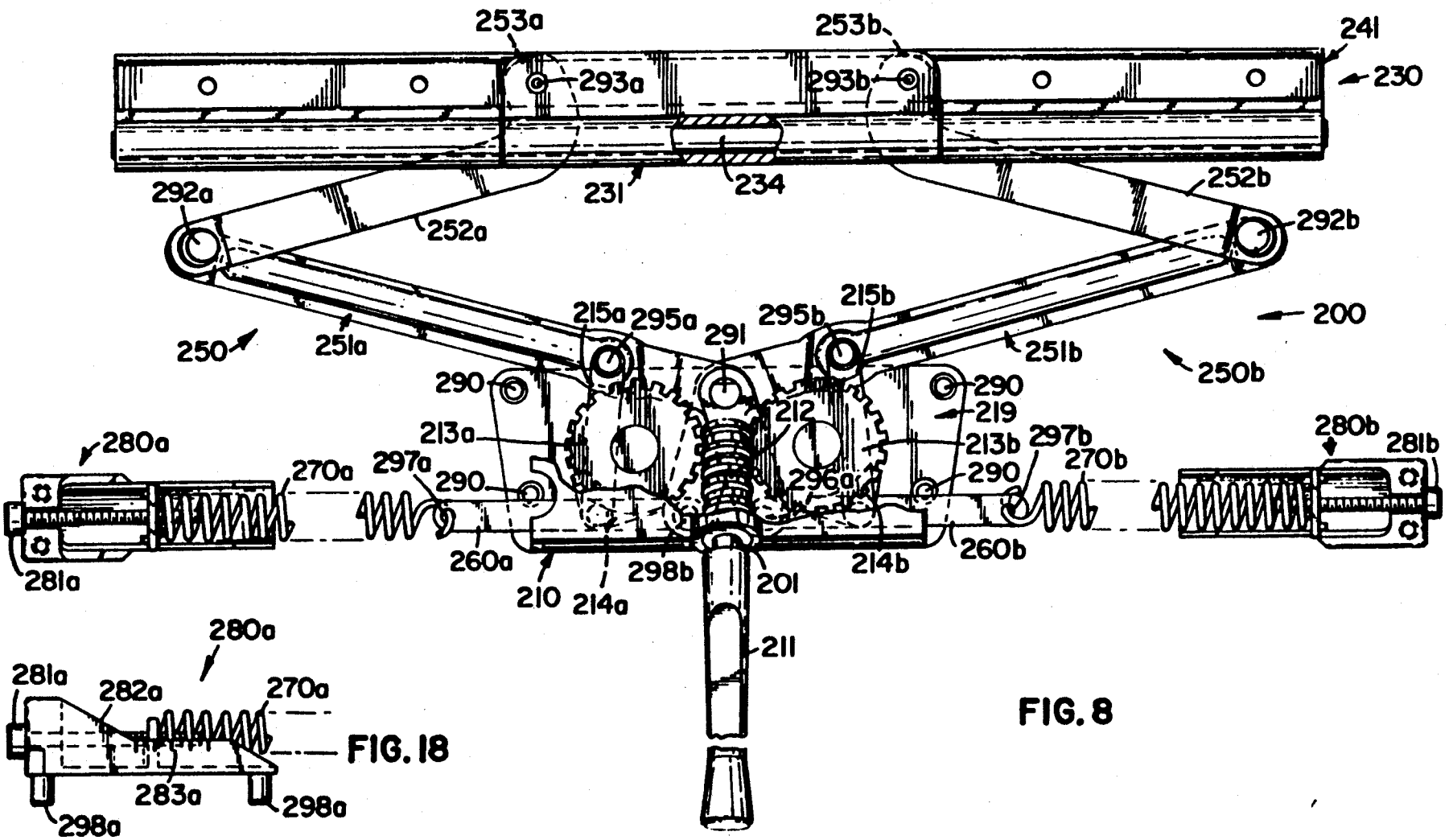
FIG. 8 is a top view of a preferred commercial embodiment of a counterbalanced window operator constructed according to the principles of the present invention.
FIG. 18 is a front view of an anchor bracket shown in FIG. 8.
Figure 19:
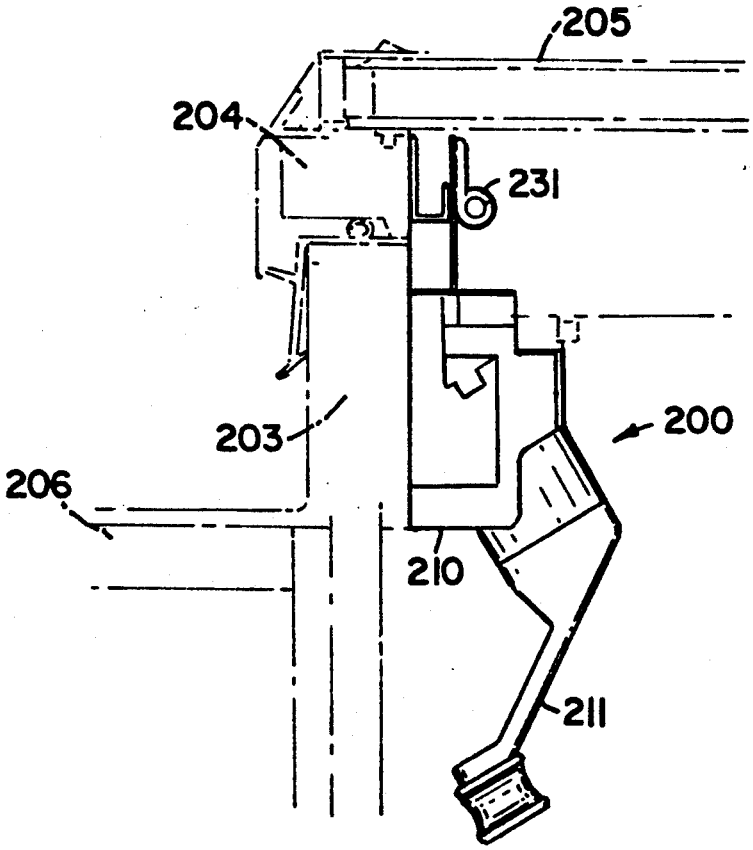
FIG. 19 is a side view of the counterbalanced window operator shown in FIG. 8, with the operator shown in relation to an installed roof window.

As shown in FIG. 19, the preferred commercial embodiment of the counterbalanced window operator (or mechanism) 200 is operatively connected to the window frame or sill 203 and the bottom member 204 of the sash 205. Referring to FIG. 8, the mechanism 200 includes a base plate 219, which is mounted to the sill 203 by screws through holes 290 or other suitable means, and a housing 210, which mounts over the base plate 219.

Figure 9:
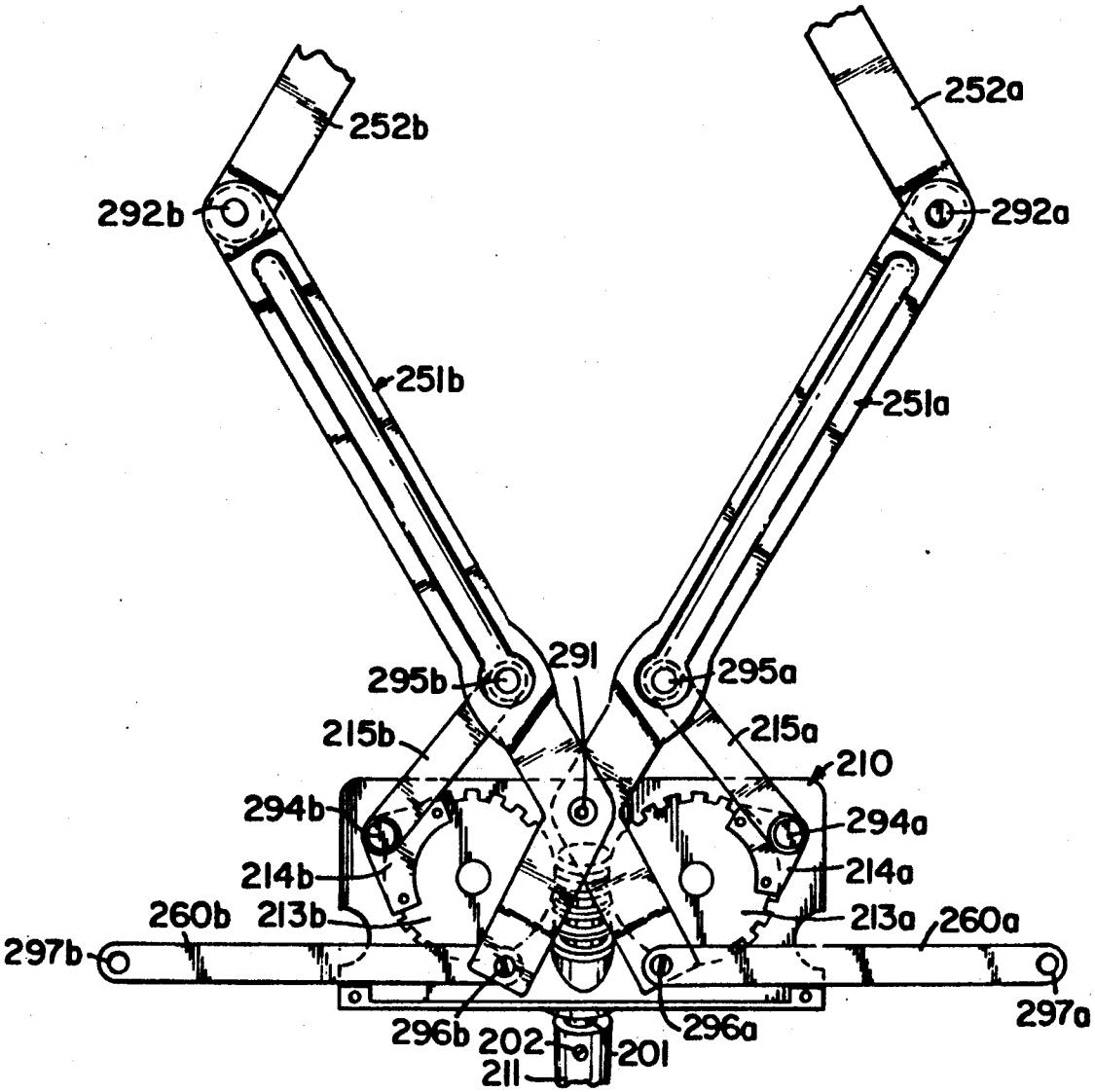
FIG. 9 is a bottom view of the counterbalanced window operator shown in FIG. 8 with the baseplate removed.

A rotatable drive member is mounted within the housing 210. The drive member includes a pair of worm gears 213a and 213b that are mounted by standoffs to the base plate 219. A worm drive 212 is operatively positioned between the two worm gears 213a and 213b in such a manner that rotation of the worm drive 212 translates into rotation of the two worm gears 213a and 213b. As shown in FIGS. 8 and 9, a spline 201 extends from the worm drive 212 through an opening in the housing 210, and a crank handle 211 is secured to the spline 201 by a set screw 202 or other suitable means. The crank handle 211 provides a convenient means for rotating the worm drive 212, which in turn rotates the worm gears 213a and 213b.

The mechanism 200 also has opposing double scissors arm members 250a and 250b, including first arm members 251a and 251b and second arm members 252a and 252b, respectively. The first (or lower) arm members 251a and 251b are pivotally mounted (by a pin member 291) at a common pivot point to the base plate 219, as well as relative to one another. Referring to FIGS. 11–14, the lower arm members 251a and 251b are of the same general shape as a hockey stick, with a first, relatively short section (223a or 223b) extending from a first end (221a or 221b) to approximately the common pivot point at pin member 291, and a second, relatively long section (224a or 224b) extending from approximately the common pivot point to a second (or distal) end (222a or 222b).

The lower arm members 251a and 251b may also be described in terms of surfaces, including first surfaces defined by the distal ends (222a and 222b), second surfaces 226a and 226b defined by the parts of the longer portions (224a and 224b) extending from the distal ends to just beyond the pivot points of the linking member (215a and 215b), third surfaces 225a and 225b defined by the remainders of the longer 223b) extending up to the first ends (221a and 221b), and fourth surfaces defined by the first ends. Note that the lower arm members 251a and 251b are of substantially uniform thickness, so that the relationships between the identified surfaces hold true for the surfaces on the opposite sides of the respective lower arm members. Also, the identified surfaces face upward and thus, are visible in FIG. 8, as well as FIGS. 11 and 13.

Figure 10:
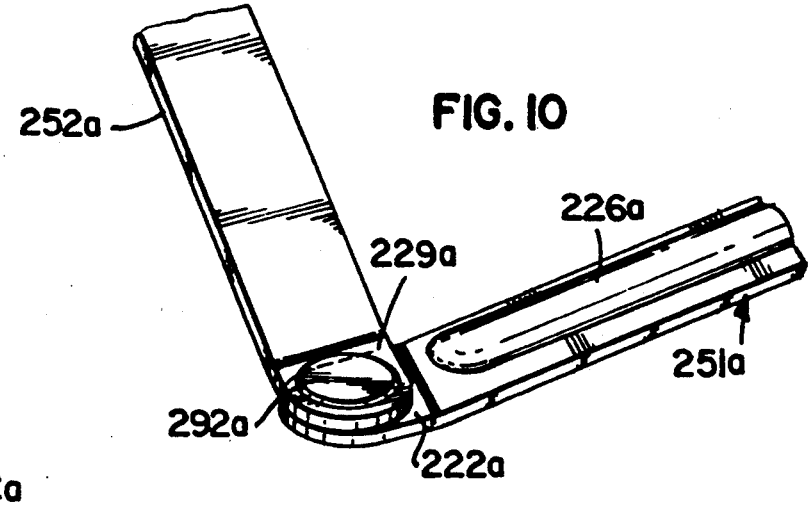
FIG. 10 is a perspective view of the region of pivotal connection of corresponding lower and upper arm members shown in FIGS. 8 and 9.
Figure 11:
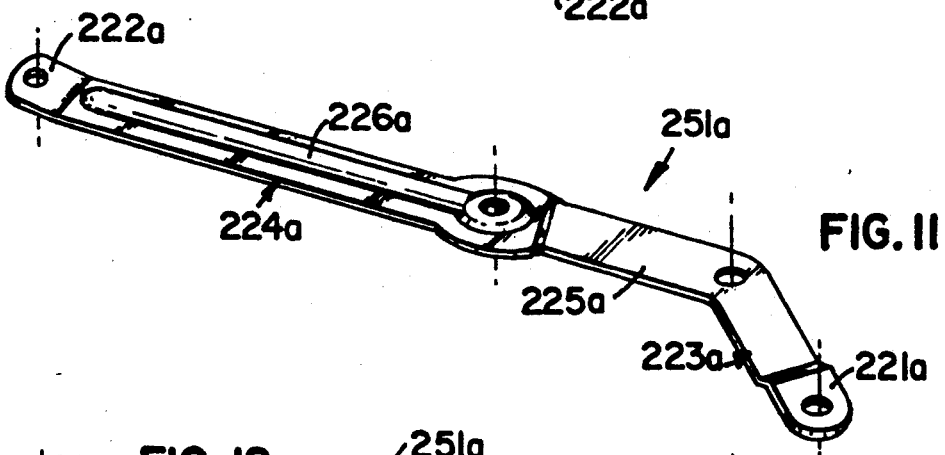
FIG. 11 is a perspective view of the first lower arm member shown in FIGS. 8 (on left) and 9 (on right)
Figure 12:
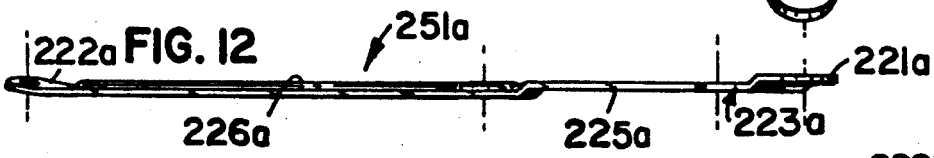
FIG. 12 is a side view of the first lower arm member shown in FIG. 11.
Figure 13:
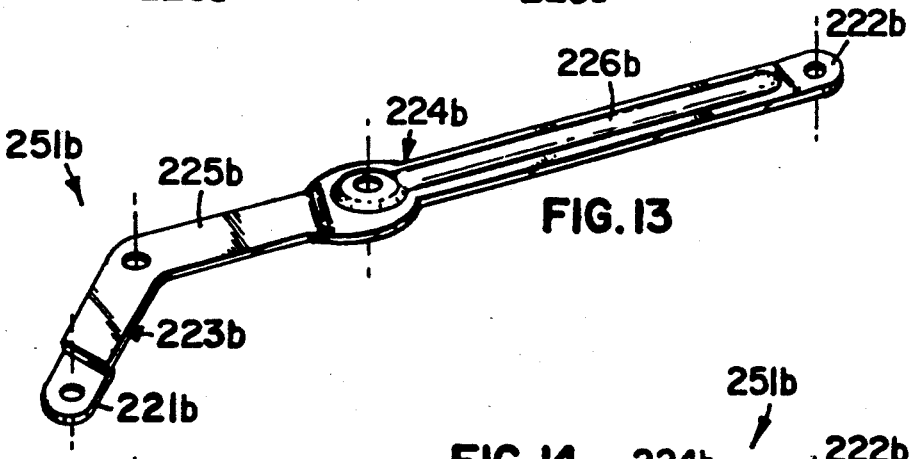
FIG. 13 is a perspective view of the second lower arm member shown in FIGS. 8 (on right) and 9 (on left)
Figure 14:
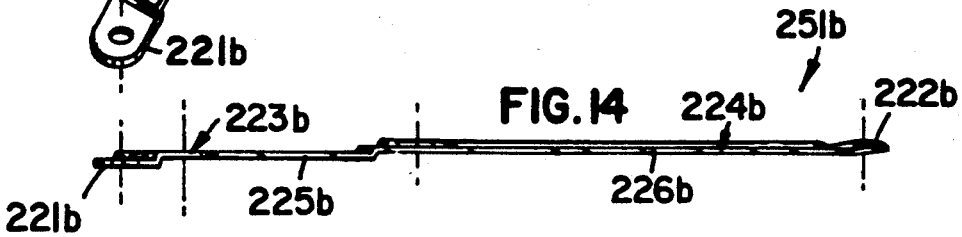
FIG. 14 is a side view of the second lower arm member shown in FIG. 13.

Referring to FIGS. 8 and 10, the second (or upper) arm members 252a and 252b are pivotally mounted at their first ends 229a and 229b (by pin members 292a and 292b) to the distal ends 222a and 222b of their respective lower arm members 251a and 251b. A washer or spacer is positioned between the pivotally mounted ends. The upper arm members 252a and 252b are basically L-shaped and extend from their first ends 229a and 229b to second (or remote) ends 253a and 253b, which extend perpendicularly relative to the longitudinal axis of the upper arm members 252a and 252b. The exact structure and operation of the arm members will be discussed in greater detail below.

Figure 17:
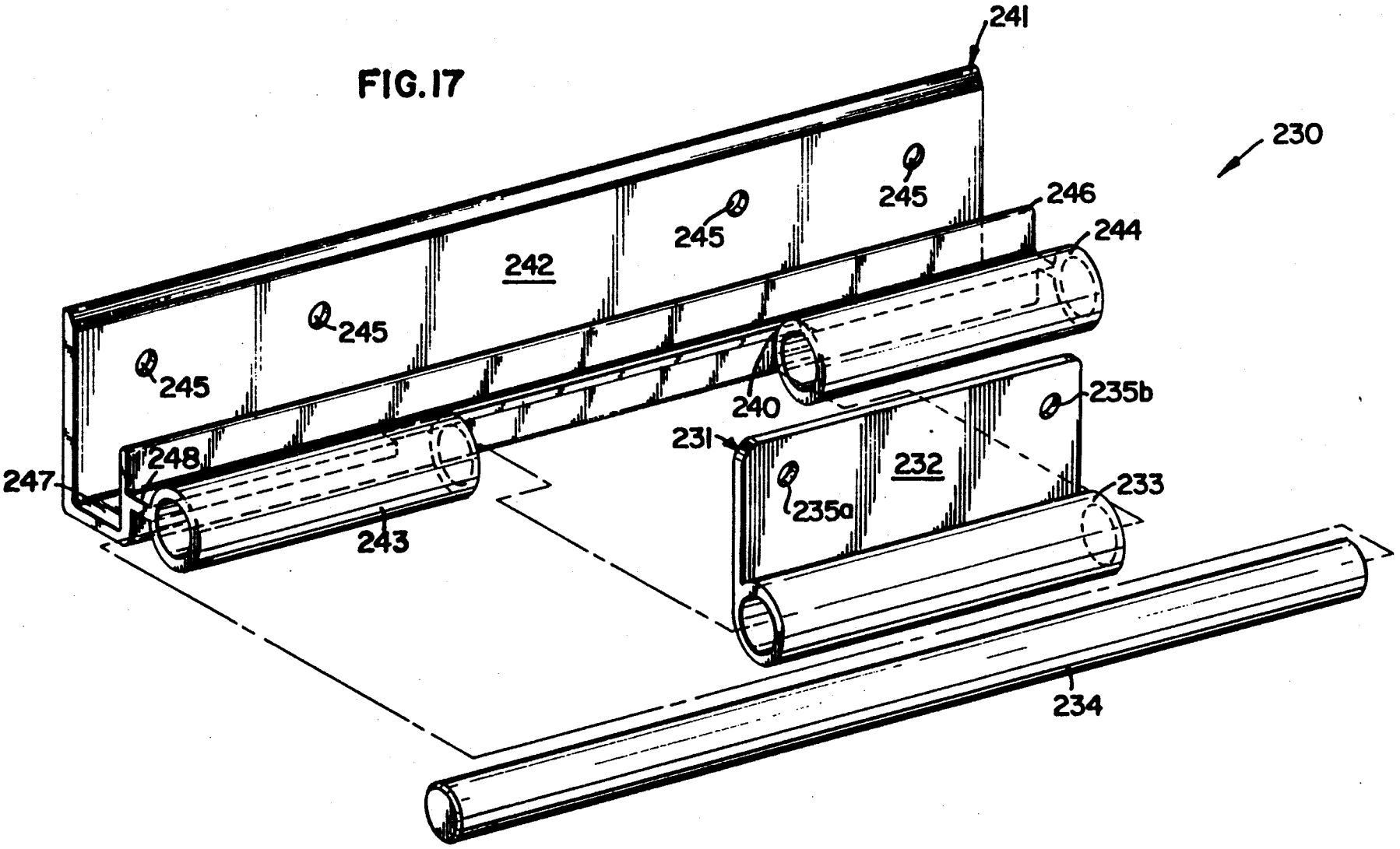
FIG. 17 is an exploded perspective view of the sash mounting means shown in FIG. 8.

The remote ends 253a and 253b of the upper arm members 252a and 252b are secured (by pin members 293a and 293b) to a hinge member 231. Referring to FIG. 17, which is enlarged for ease of illustration, the hinge member 231 is part of a sash mounting means 230, which also includes a sash bracket 241 and a connecting rod 234. The hinge member 231 includes a tube member 233 and a plate member 232, which has holes 235a and 235b to receive the pin members 293a and 293b, respectively. The sash bracket 241 includes a plate member 242 and a flange member 246, which are integrally joined by a first lateral member 247, thereby defining a squared, U-shaped channel into which condensation may run and collect and eventually evaporate. A series of holes 245 allow the sash bracket 241 to be secured to the bottom member 204 of the sash 205 by screws (not shown) or other suitable means.

A second lateral member 248 extends from the flange member 246, in a direction opposite the first lateral member 247, and integrally joins the flange member 246 to two axially aligned tube members 243 and 244. The tube members 243 and 244 are spaced apart a distance at least as great as the length of the hinge member 231, and the second lateral member 246 is notched along its length in the region defined by the spacing of the two tube members 243 and 244. Recess 240 provides additional space for the attachment of the upper arm members 252a and 252b to the hinge member 231. The recess 240 is also sufficiently large to accommodate rotation of the hinge member 231, as well as the upper arm members 252a and 252b, relative to the sash bracket 241.

The inner diameters of the tube members 233, 243, and 244 are greater than the diameter of the connecting rod 234, and when the free tube member 233 is axially aligned relative to the two fixed tube members 243 and 244, the connecting rod 234 may be inserted through all three tube members to rotatably secure the hinge member 231 relative to the sash bracket 241. The connecting rod 234 is confined spatially between the inner surfaces of the window sash. However, those skilled in the art will recognize that the connecting rod 234 may alternatively be secured in place by one of several known means, such as friction fit with one of the tube members or lock-nuts at the ends of the connecting rod 234. In an alternative embodiment, the hinge member 231 is rotatably secured relative to an alternative sash bracket by spring-loaded plungers extending from the sash bracket into the ends of the tube member 233.

Referring back to FIGS. 8 and 9, in operation the double scissors the arm members 250a and 250b are subjected to three primary forces, one of which is obviously the weight of the window. The second primary force is generated by rotation of the crank handle 211 in a first direction. The rotational force is transmitted from the worm gears 213a and 213b to the lower arm members 251a and 251b by linking members 215a and 215b, respectively. The linking members 215a and 215b are pivotally connected at one end (by pin members 295a and 295b) above the second surfaces 226a and 226b of the respective lower arm members 251a and 251b. The respective pivot points are located on the relatively long sections 224a and 224b of the respective lower arm members 251a and 251b, just beyond the third surfaces 225a and 225b. At an opposite end, the linking members 215a and 215b are pivotally connected (by pin members 294a and 294b) to respective tabs 214a and 214b on the worm drive 213a and 213b. The tabs 214a and 214b are secured to the worm gears 213a and 213b by riveting, welding, or other known means.

The relative sizes and locations of the gears, linking members, and arm members are designed so that when the window is substantially closed, the window may be snugly closed with one additional turn of the crank handle 211. In particular, during the course of the final, closing turn of the crank handle 211, the longitudinal axes of the linking members 215*a* and 215*b* pass over the centers (or axes) of the worm gears 213*a* and 213*b*, respectively, toward one another. Those skilled in the art will recognize the mechanical advantage provided by this over center arrangement. A stop mechanism (not shown) may be added to prevent the crank handle from rotating too far beyond the off center position.

The third primary force to act upon the arm members is a spring force that is intended to offset (or counterbalance) the weight of the window. At the first ends 221*a* and 221*b*, the lower arm members 251*a* and 251*b* are pivotally connected (by pin members 296*a* and 296*b*) to tension members 260*a* and 260*b*, respectively, which extend through openings in the housing 210.

The fourth surface of the first lower arm member 251*a* is offset upward relative to the third surface 225*a* to receive the first tension member 260*a* mounted beneath the first end 221*a*, as shown in FIG. 9 (a bottom view). Conversely, the fourth surface of the second lower arm member 251*b* is offset downward relative to the third surface 225*b* to receive the second tension member 260*b* mounted above the first end 221*b*.

The tension members 260*a* and 260*b* are in turn operatively connected (by means of holes 297*a* and 297*b*) to coil springs 270*a* and 270*b*, respectively, which are external to the housing 210 but are otherwise concealed from view by a cover (not shown). The other ends of the springs 270*a* and 270*b*, opposite the tension members 260*a* and 260*b*, are secured relative to anchor brackets 280*a* and 280*b*, respectively, by bolt members 281*a* and 281*b*. The anchor brackets 280*a* and 280*b* are mounted to the sill 203 by posts (298*a* for anchor bracket 280*a*) or other known means. The tension members, coil springs, anchor brackets, and bolt members are all linearly aligned relative to one another.

The preload forces in the springs 270*a* and 270*b* can be adjusted by rotating the bolt members 281*a* and 281*b* relative to the respective anchor brackets 280*a* and 280*b*. As shown in FIG. 18, where anchor bracket 280*a* is exemplary of anchor bracket 280*b*, a preload scale or gauge 283*a* is affixed to the sidewall 282*a*. The scale 283*a* may be used to adjust the tension in the spring 270*a* according to factory specifications based on the pitch of the roof, the weight of the window, and the size of the spring. Thus, by using springs of different sizes and providing adjustment means, the present invention facilitates the production of a single, standard window unit that can accommodate a wide range of applications.

For purposes of discussing the operation of the present invention, it may be assumed that the initial incremental opening of the window is in a direction perpendicular to the roof 206 in which the roof window assembly 299 is installed. However, by definition, a pivoting unit has a rotatable end that rotates about a pivoted end, so that the next incremental movement of the window curves upward away from the normal to the roof. Recognizing that the lower ends of the lower arm members 251*a* and 251*b* are pivotally fixed (by pin member 291) at the approximate closure point of the pivoting unit or sash, the upper ends of the upper arm members 252*a* and 252*b* cannot simply extend linearly outward normal to the roof as the window opens, because the upper ends are rotatably fixed (by pin member 293*a* and 293*b*) to the bottom 204 of the sash 12. Thus, the span of the arm members 250*a* and 250*b* must accommodate the movement of the rotatable end in an upward arc away from the normal to the roof.

The lower arm members 251*a* and 251*b* define a first plane that is substantially perpendicular to the roof 206 regardless of the orientation of the window 205. In other words, as the window is cranked open, the outward extension of the lower arm members 251*a* and 251*b* is confined to this first plane. However, the bent ends 222*a* and 222*b* and 229*a* and 229*b* of the lower arm members and upper arm members 251*a* and 251*b* and 252*a* and 252*b*, respectively, are such that the outward extension of the upper arm members 252*a* and 252*b* is not confined to a single plane. Rather, the upper arm members 252*a* and 252*b* ramp upward away from the first plane as the window is cranked open, thereby defining planes that are increasingly oblique (or inclined) relative to the first plane of the lower arm members 251*a* and 251*b* and also, relatively more perpendicular to the sash.

Figure 15:
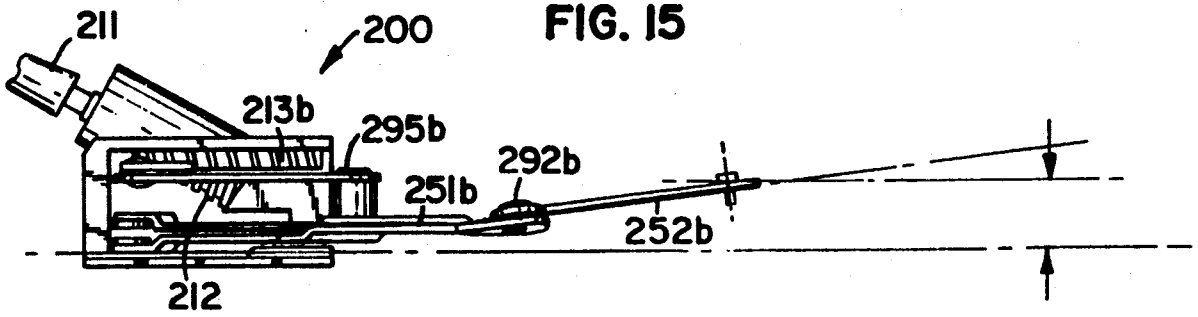
FIG. 15 is a side view of the counterbalanced window operator shown in FIG. 8 with the double scissors arm members in a first position.
Figure 16:
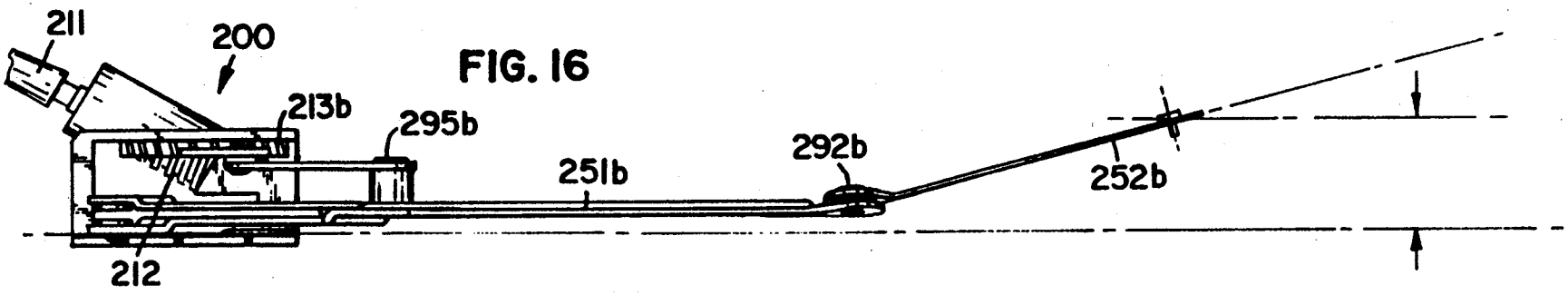
FIG. 16 is a side view of the counterbalanced window operator shown in FIG. 8 with the double scissors arm members in a second, relatively more open position.

The exact nature of the bent ends may also be described in terms of reference planes. Referring to FIGS. 15 and 16, when the sash is in an open position, the first arm members 251*a* and 251*b* define a first plane, and the second arm members 252*a* and 252*b* define a second plane at an oblique angle relative to the first plane. When the sash is in a closed position, the first arm members 251*a* and 251*b* continue to define the same first plane, and the second arm members 252*a* and 252*b* define a third plane at an angle less oblique relative to the first plane, with the foregoing in mind, the second ends 222*a* and 222*b* of the first arm members may be described as having been bent out of the first plane toward the second plane, and the first ends 229*a* and 229*b* of the second arm members may be described as having been bent out of the second plane toward the first plane. Alternatively, the bends are such that when the window is closed, the ends 222*a* and 222*b* and 229*a* and 229*b* are bent toward the top or pivoting end of the sash, as compared to the orientation of the arm members in general.

In any event, the resulting non-linear extension of the arm members approximates the rotation of the rotatable end of the window and therefore, reduces non-essential stress and sloppiness in the various components of the mechanism. Additionally, the hinged relationship between the hinge member 231 and the sash bracket 241 provides additional relief to the extent that the non-linear extension may not precisely track the rotation of the rotatable end.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follow in the spirit and broad scope of the appended claims are included.

We claim:

1. An operator for a pivoting unit, the unit having a first, pivoted end and a second, rotatable end, the operator comprising:

(a) a housing;

(b) a rotatable drive member operatively mounted in said housing, said drive member having an axis of rotation;

(c) a pair of first arm members having first and second ends, said drive member operatively connected to said first arm members proximate said first ends;

(d) a pair of second arm members having first and second ends, said first ends of said second arm members operatively connected to said second ends of said first arm members, and said second ends of said second arm members operatively connected to the second, rotatable end of the pivoting unit, wherein a torque from the unit is transmitted to said first and second arm members, wherein the second, rotatable end of the pivoting unit is rotatable from a closed position to an open position, and when the second, rotatable end is in said open position, said first arm members generally define a first plane, and said second arm members generally define a second plane at an oblique angle relative to said first plane;

(e) rotating drive means for rotating said drive member;

(f) counterbalancing means, operatively connected to said first arm members, for counterbalancing the torque on said first and second arm members, said counterbalancing means creating a force that is transmitted to said first and second arm members; and (g) a pair of linking members that operatively connect said first arm members to said drive member so as to provide an over center advantage as the second, rotatable end of the pivoting unit is rotated to said closed position.

2. An operator according to claim 1, wherein when the second, rotatable end of the pivoting unit is in said closed position, said second arm members generally define a third plane at an angle less oblique relative to said first plane.

3. An operator according to claim 2, wherein when the second, rotatable end of the pivoting unit is in said closed position, said first arm members continue to generally define said first plane.

4. An operator according to claim 1, wherein said second ends of said first arm members are bent out of said first plane toward said second plane, and said first ends of said second arm members are bent out of said second plane toward said first plane.

5. An operator according to claim 1, wherein said second arm members are individually, pivotally connected to a hinge member on the second, rotatable end of the pivoting unit.

6. An operator according to claim 1, wherein said drive means comprises:

(a) a crank handle;

(b) a worm drive, said worm drive being rotated by rotation of said crank handle; and (c) a worm gear in operative engagement with said worm drive, said worm gear having a propelling member operatively connected thereto.

7. An operator according to claim 6, wherein said drive member has a socket configured to receive said propelling member.

8. An operator according to claim 1, wherein said counterbalancing means comprises a pair of springs operatively connected to said first ends of said first arm members.

9. An operator according to claim 8, further comprising adjusting means, operatively connected to said springs, for adjusting preload forces on said springs.

10. An operator according to claim 9, further comprising gauging means for gauging adjustments to said preload forces on said springs.

11. An operator for a pivoting unit, the unit having a first, pivoted end and a second, rotatable end, the operator comprising:

(a) a housing;

(b) a rotatable drive member operatively mounted in said housing, said drive member having an axis of rotation;

(c) a pair of first arm members having first and second ends, said drive member operatively connected to said first arm members proximate said first ends said first arm members have a common pivot point;

(d) a pair of second arm members having first and second ends, said first ends of said second arm members operatively connected to said second ends of said first arm members, and said second ends of said second arm members operatively connected to the second, rotatable end of the pivoting unit, wherein a torque from the unit is transmitted to said first and second arm members, wherein the second, rotatable end of the pivoting unit is rotatable from a closed position to an open position, and when the second, rotatable end is in said open position, said first arm members generally define a first plane, and said second arm members generally define a second plane at an oblique angle relative to said first plane;

(e) rotating drive means for rotating said drive member; and (f) counterbalance means, operatively connected to said first arm members, for counterbalancing the torque on said first and second arm members, said counterbalancing means creating a force that is transmitted to said first and second arm members.

12. A roof window assembly, comprising:

(a) a frame having a top end and a bottom end;

(b) a sash having a top end and a bottom end, said sash configured to engage said frame, and said top end of said sash pivotally mounted to said top end of said frame, and said bottom end of said sash being rotatable into and out of engagement with said bottom end of said frame; and (c) a counterbalanced roof window operator, comprising:

(i) a housing;

(ii) a rotatable drive member operatively mounted in said housing, said drive member having an axis of rotation;

(iii) a pair of first arm member having first and second ends, said drive member operatively connected to said first arm members proximate said first ends;

(iv) a pair of second arm members having first and second ends, said first ends of said second arm members operatively connected to said second ends of said first arm members, and said second ends of said second arm members individually, pivotally connected to a hinge member on said bottom of said sash, wherein a torque from said sash is transmitted to said first and second arm members.

(e) rotating drive means for rotating said drive member;

(f) counterbalancing means, operatively connected to said first arm members, for counterbalancing the torque on said first and second arm members, said counterbalancing means creating a force that is transmitted to said first and second ar members; and (g) a sash bracket mounted to said bottom end of said sash, and to which said hinge member is rotatably mounted, wherein said sash bracket defines a condensation channel into which condensation may run and collect.

13. A roof window assembly, comprising:

(a) a frame having a top end and a bottom end;

(b) a sash having a top end and a bottom end, said sash configured to engage said frame, and said top end of said sash pivotally mounted to said top end of said frame, and said bottom end of said sash being rotatable into and out of engagement with said bottom end of said frame; and (c) a counterbalanced roof window operator, comprising:

(i) a housing;

(ii) a rotatable drive member operatively mounted in said housing, said drive member having an axis of rotation;

(iii) a pair of first arm members having first and second ends, said drive member operatively connected to said first arm members proximate said first ends;

(iv) a pair of second arm members having first and second ends, said first ends of said second arm members operatively connected to said second ends of said first arm members, and said second ends of said second arm members individually, pivotally connected to a hinge member on said bottom of said sash, wherein a torque from said sash is transmitted to said first and second arm members;

(e) rotating drive means for rotating said drive member;

(f) counterbalancing means, operatively connected to said first arm members, for counterbalancing the torque on said first and second arm members, said counterbalancing means creating a force that is transmitted to said first and second arm members; and (g) a pair of linking members that operatively connect said first arm members to said drive member so as to provide an over center advantage as the second, rotatable end of the pivoting unit is rotated to said closed position.

14. A roof window assembly according to claim 13, wherein 6 or less revolutions of said rotating drive means results in a movement of 25 or more centimeters of said bottom end of said sash.

15. A roof window assembly according to claim 13, wherein said counterbalancing means comprises a pair of springs operatively connected to said first ends of said first arm members.

16. A roof window assembly according to claim 15, further comprising adjusting means, operatively connected to said springs, for adjusting preload forces on said springs.

17. A roof window assembly according to claim 16, further comprising gauging means for gauging adjustments to said preload forces on said springs according to installation parameters for the roof window assembly.

18. A roof window assembly according to claim 13, further comprising a sash bracket mounted to said bottom end of said sash, and to which said hinge member is rotatably mounted, wherein said sash bracket defines a condensation channel into which condensation may run and collect.

19. A roof window assembly according to claim 13, wherein said drive means comprises:

(a) a crank handle;

(b) a worm drive, said worm drive being rotated by rotation of said crank handle; and (c) a worm gear in operative engagement with said worm drive, said worm gear having a propelling member operatively connected thereto.

20. A roof window assembly according to claim 19, wherein said drive member has a socket configured to receive said propelling member.

21. A roof window assembly according to claim 13, wherein when said bottom end of said sash is out of engagement with said bottom end of said frame, said first arm members generally define a first plane, and said second arm members generally define a second plane at an oblique angle relative to said first plane.

22. A roof window assembly according to claim 13, wherein said second ends of said first arm members and said first ends of said second arm members are bent such that when said bottom end of said sash is in engagement with said bottom end of said frame, said second ends of said first arm members and said first ends of said second arm members are bent toward said top end of said frame and said top end of said sash relative to said first arm members and said second arm members.

23. The roof window assembly of claim 13, wherein said first arm members have a common pivot point.

* * * * *

UNITED STATES PATENT AND TRADEMARK OFFICE

CERTIFICATE OF CORRECTION

PATENT NO. : 5,205,074

DATED : April 27, 1993

INVENTOR(S) : James C. Guhl, et al.

It is certified that error appears in the above-indentified patent and that said Letters Patent is hereby corrected as shown below:

Column 9, Line 40, delete "223b)" after the word "longer".

Column 9, Line 40, insert --portions and the parts of the shorter portions (223a and 223b)-- after the word "longer".

Column 14, Claim 12, Line 48, "member" should read --members--.

Column 14, Claim 12, Line 67, "ar" should read --arm--.

Signed and Sealed this

Eleventh Day of January, 1994

Bruce Lehman

*Attest:*

BRUCE LEHMAN

*Attesting Officer*

*Commissioner of Patents and Trademarks*